US012428607B2

(12) United States Patent
Komuro et al.

(10) Patent No.: US 12,428,607 B2
(45) Date of Patent: Sep. 30, 2025

(54) LUBRICANT COMPOSITION

(71) Applicant: IDEMITSU KOSAN CO., LTD., Chiyoda-ku (JP)

(72) Inventors: Yuji Komuro, Ichihara (JP); Kiyohiko Yokota, Ichihara (JP); Kiyokazu Katayama, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/555,638

(22) PCT Filed: Apr. 19, 2022

(86) PCT No.: PCT/JP2022/018222
§ 371 (c)(1),
(2) Date: Oct. 16, 2023

(87) PCT Pub. No.: WO2022/224970
PCT Pub. Date: Oct. 27, 2022

(65) Prior Publication Data

US 2024/0218283 A1 Jul. 4, 2024

(30) Foreign Application Priority Data

Apr. 20, 2021 (JP) ..... 2021-071355

(51) Int. Cl.

| | |
|---|---|
| ***C10M 169/04*** | (2006.01) |
| ***C10M 107/10*** | (2006.01) |
| ***C10M 129/76*** | (2006.01) |
| *C10N 20/04* | (2006.01) |
| *C10N 30/00* | (2006.01) |
| *C10N 30/02* | (2006.01) |
| *C10N 30/10* | (2006.01) |

(52) U.S. Cl.
CPC ..... *C10M 169/04* (2013.01); *C10M 107/10* (2013.01); *C10M 129/76* (2013.01); *C10M 2207/285* (2013.01); *C10N 2020/04* (2013.01); *C10N 2030/02* (2013.01); *C10N 2030/10* (2013.01); *C10N 2030/74* (2020.05)

(58) Field of Classification Search
CPC ..... C10M 169/04; C10M 107/10; C10M 129/76; C10M 2207/285; C10M 107/02; C10M 129/10; C10M 133/12; C10N 2020/04; C10N 2030/02; C10N 2030/10; C10N 2030/74; C10N 2030/00; C10N 2040/08; C10N 2040/04
USPC ..... 208/18
See application file for complete search history.

(56) References Cited

U.S. PATENT DOCUMENTS

| | | | | |
|---|---|---|---|---|
| 2007/0287646 | A1* | 12/2007 | Kawamura | F16C 33/6633 508/590 |
| 2010/0009878 | A1 | 1/2010 | Baba et al. | |
| 2011/0207977 | A1* | 8/2011 | Fujikawa | C10M 127/02 585/16 |
| 2019/0203148 | A1 | 7/2019 | Schöller et al. | |
| 2022/0145208 | A1 | 5/2022 | Ishii et al. | |
| 2022/0251461 | A1 | 8/2022 | Yokota et al. | |

FOREIGN PATENT DOCUMENTS

| | | | |
|---|---|---|---|
| JP | 2007-238720 | A | 9/2007 |
| JP | 2008-94969 | A | 4/2008 |
| JP | 2008-179669 | A | 8/2008 |
| JP | 2016-11384 | A | 1/2016 |
| JP | 2018-203953 | A | 12/2018 |
| JP | 2019-532134 | A | 11/2019 |
| WO | WO 2010/053022 | A1 | 5/2010 |
| WO | WO 2020/189580 | A1 | 9/2020 |
| WO | WO 2021/015172 | A1 | 1/2021 |

OTHER PUBLICATIONS

International Search Report and Written Opinion issued Jul. 19, 2022, in PCT/JP2022/018222 (with English Translation), citing documents 15-21 therein, 17 pages.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A lubricating oil composition containing a poly-α-olefin and an antioxidant, in which an evaporation loss by the Noack method is 4.9% by mass or less, a kinematic viscosity at 100° C. is 6.5 $mm^2$/sec or less, and an amount of the antioxidant with respect to the poly-α-olefin is 0.05% by mass or more.

20 Claims, No Drawings

LUBRICANT COMPOSITION

CROSS REFERENCE TO RELATED APPLICATIONS

This application is a National Stage entry under 35 U.S.C. § 371 of PCT/JP2022/018222, filed on Apr. 19, 2022, and claims priority to Japanese Patent Application No. 2021-071355, filed on Apr. 20, 2021. The entire contents of both are incorporated herein by reference.

TECHNICAL FIELD

The present invention relates to a lubricating oil composition.

BACKGROUND ART

From the viewpoint of environmental protection, lubricating oils having low evaporation amount are required. Furthermore, when the evaporation amount is high, it is not only undesirable for the environment, but also a viscosity of the lubricating oil becomes high due to the evaporation of the low-viscosity components. When the viscosity of the lubricating oil is high, the friction becomes great.

As an example of an attempt to reduce the evaporation, Patent Document 1 discloses the use of polyalkylacrylate-based comb shaped polymers containing esters of acrylic acid and hydroxylated hydrogenated polybutadiene, and alkylacrylates, as the additives to the lubricating oils.

On the other hand, as the lubricating oils with excellent stability, poly-α-olefins which are composed of hydrocarbons and have high chemical stability, are widely used. Under these circumstances, attempts have been made to obtain the lubricating oils having various properties by adding additives to the poly-α-olefins.

For example, Patent Document 2 discloses a lubricating oil composition obtained by blending a base oil, containing a specific dialkyl monoether and a poly-α-olefin, in order to impart the various properties such as low viscosity, viscosity-temperature characteristics, low-temperature fluidity, evaporation characteristics, shear stability, oxidation stability, and swelling-suppressing of organic materials.

CITATION LIST

Patent Literature

PTL 1: JP2019-532134 A
PTL 2: JP2016-011384 A

SUMMARY OF INVENTION

Technical Problem

A base oil having low viscosity is generally required for lubricating oils for machines from the viewpoint of fuel saving. However, it is usually necessary to lower the molecular weight, in order to lower the viscosity. When the molecular weight is lowered, it becomes easy to evaporate, and there is a problem that the durability (oil life) is deteriorated. This is not preferable in terms of the environmental aspect as described above.

Regarding volatility of the lubricating oils, an index of evaporation loss by the Noack method is used, and the low evaporation loss is required.

Therefore, there has been a demand for the lubricating oils having low viscosity and small evaporation loss by the Noack method from the viewpoint of environmental protection and durability while maintaining the lubricating properties.

Therefore, an object of the present invention is to provide a lubricating oil composition having low viscosity and small evaporation loss by the Noack method, and which is suitable for long-term use.

Solution to Problem

The present inventors have made intensive studies to solve the above problems, and as a result, have found that a lubricating oil composition having small evaporation loss by the Noack method and low kinematic viscosity, and containing a specific amount of a poly-α-olefin and an antioxidant, can solve the above problems.

Specifically, the present invention relates to the below items (1) to (10).

(1) A lubricating oil composition containing a poly-α-olefin and an antioxidant, in which an evaporation loss by the Noack method is 4.9% by mass or less, a kinematic viscosity at 100° C. is 6.5 $mm^2$/sec or less, and an amount of the antioxidant with respect to the poly-α-olefin is 0.05% by mass or more.

(2) The lubricating oil composition according to the (1), in which the poly-α-olefin is a polymerized product of an α-olefin having a carbon number of 8 to 12.

(3) The lubricating oil composition according to the (1) or (2), in which the poly-α-olefin is a product obtained by dimerizing an α-olefin with a metallocene catalyst, further dimerizing the dimerized product with an acid catalyst and then performing a hydrogenation.

(4) The lubricating oil composition according to the (2) or (3), in which the α-olefin is 1-decene.

(5) The lubricating oil composition according to any one of the (1) to (4), in which a boiling point of the antioxidant is 250° C. or higher.

(6) The lubricating oil composition according to any one of the (1) to (5), in which the antioxidant is at least one selected from the group consisting of phenolic antioxidants, amine antioxidants, and zinc dialkyldithiophosphates.

(7) The lubricating oil composition according to any one of the (1) to (6), in which the antioxidant is tetrakis [methylene-3-(3',5-di-t-butyl-4'-hydroxyphenyl)propionate]methane.

(8) The lubricating oil composition according to any one of the (1) to (7), in which an average carbon number of the poly-α-olefin is 36 to 44.

(9) An evaporation loss reduction method of a lubricating oil by adding 0.05% by mass or more of an antioxidant with respect to a lubricant base oil which is a poly-α-olefin, so that the evaporation loss by the Noack method is 66% or less of that before adding the antioxidant.

(10) The evaporation loss reduction method of a lubricating oil according to the (9), in which an average carbon number of the poly-α-olefin is 36 to 44.

Advantageous Effects of Invention

According to the present invention, it is possible to provide a lubricating oil composition which has low viscosity and small evaporation loss by the Noack method, and which is suitable for long-term use.

DESCRIPTION OF EMBODIMENTS

The present invention is a lubricating oil composition containing a poly-α-olefin and an antioxidant, in which an evaporation loss by the Noack method is 4.9% by mass or less, a kinematic viscosity at 100° C. is 6.5 $mm^2$/sec or less, and an amount of the antioxidant with respect to the poly-α-olefin is 0.05% by mass or more.

In addition, the present invention is an evaporation loss reduction method of a lubricating oil by adding 0.05% by mass or more of an antioxidant with respect to the lubricant base oil which is a poly-α-olefin, so that the evaporation loss by the Noack method is 66% or less of that before adding the antioxidant.

The present invention will be described in detail below.

[Lubricant Composition]

The lubricating oil composition of the present invention contains a poly-α-olefin and an antioxidant, in which an evaporation loss by the Noack method is 4.9% by mass or less, a kinematic viscosity at 100° C. is 6.5 $mm^2$/sec or less, and an amount of the antioxidant with respect to the poly-α-olefin is 0.05% by mass or more.

<Poly-α-olefin>

The poly-α-olefin contained in the lubricating oil composition of the present invention is a polymer of an α-olefin, and obtained by polymerizing the α-olefin.

Next, a preferred method of producing the poly-α-olefin will be described.

(Method of Producing Poly-α-olefin)

The method of producing the poly-α-olefin is not particularly limited, but the following method is preferable.

For example, (1) a method of hydrogenating (hydrogenation) a product obtained by polymerizing an α-olefin with a metallocene catalyst, (2) a method of hydrogenating a product by polymerizing an α-olefin with an acid catalyst, (3) a method of hydrogenating a product obtained by polymerizing an α-olefin with a metallocene catalyst and further polymerizing the polymerized product with an acid catalyst. Among these, the method (3) is preferable.

Among the methods of (3), a method of hydrogenating a product obtained by polymerizing an α-olefin with a metallocene catalyst and further dimerizing the polymerized product with an acid catalyst, is more preferable. The poly-α-olefin is still more preferably a product obtained by dimerizing an α-olefin with a metallocene catalyst, further dimerizing the dimerized product with an acid catalyst and then performing a hydrogenation.

Note that, in the methods of (3), another α-olefin may be added when polymerizing an α-olefin with a metallocene catalyst and further dimerizing the polymerized product with an acid catalyst.

Raw materials and catalysts will be described, and then each suitable producing method will be described.

[α-olefin]

The α-olefin used as a raw material of the poly-α-olefin is an alkene having a carbon-carbon double bond at the α-position (terminal).

The α-olefin is preferably an α-olefin having 6 to 12 carbon atoms, more preferably an α-olefin having 8 to 12 carbon atoms, and still more preferably an α-olefin having 8 to 10 carbon atoms.

That is, the poly-α-olefin contained in the lubricating oil composition of the present invention is preferably a polymerized product of an α-olefin having 6 to 12 carbon atoms, more preferably a polymerized product of an α-olefin having 8 to 12 carbon atoms, still more preferably a polymerized product of an α-olefin having 8 to 10 carbon atoms.

In addition, a linear α-olefin represented by the general formula $$H_2C{=}CH{-}(CH_2)_n{-}CH_3$$

(in the formula, n represents an integer of 7 to 15) is preferable, a linear α-olefin having 6 to 12 carbon atoms is more preferable, a linear α-olefin having 8 to 12 carbon atoms is still more preferable, and a linear α-olefin having 8 to 10 carbon atoms is even still more preferable.

As examples of the α-olefin, 1-octene, 1-decene, 1-dodecene, 1-tridecene, 1-tetradecene, 1-pentadecene, 1-hexadecene, 1-heptadecene, 1-octadecene etc., are given. 1-octene, 1-decene, 1-dodecene and 1-tetradecene are preferable, 1-octene and 1-decene are more preferable, and 1-decene is still more preferable. These α-olefins may be used singly or in a combination of two or more.

[Metallocene Catalyst]

The metallocene catalyst containing (i) a metallocene complex which has a ligand including a conjugated five-membered carbon ring, and contains a transition metal belonging to Groups 4 to 6 of the Periodic Table, and (ii) at least one selected from (ii-1) a compound composed of a cation and an anion in which a plurality of groups are bound to an element and (ii-2) an organoaluminum compound, can be preferably used as the metallocene catalyst.

The component (i) constituting the catalyst, i.e., the metallocene complex which has a ligand including a conjugated five-membered carbon ring, and contains a transition metal selected from Groups 4-6 of the Periodic Table, from the viewpoint of catalytic activity, is preferably a transition metal compound represented by the following general formula (2) or (3):

$$Q^1_a(C_5H_{5-a-b}R^3_b)\,(C_5H_{5-a-c}R^4_c)\,M^1X_eY_f \tag{2}$$

$$Q^2_a(C_5H_{5-a-d}R^4_d)\,ZM^1X_eY_f \tag{3}$$

In the formulae, $Q^1$ represents a linking group that crosslinks the two conjugated five-membered ring ligands, $(C_5H_{5-a-b}R^3_b)$ and $(C_5H_{5-a-c}R^4_c)$, and $Q^2$ represents a linking group that crosslinks the conjugated five-membered ring ligand $(C_5H_{5-a-d}R^5_d)$ and the Z group. (e+f) is equal to (the valence of $M^1$-2). $M^1$ represents a transition metal belonging to Groups 4 to 6 of the Periodic Table. X, Y and Z each represent a covalent or ion-binding ligand.

Specific examples of $Q^1$ and $Q^2$ include (1) an alkylene group having 1 to 4 carbon atoms or a cycloalkylene group, which may have a lower-alkyl or phenyl side-chain substituent, such as a methylene group, an ethylene group, an isopropylene group, a methylphenyl methylene group, a diphenyl methylene group, or a cyclohexylene group, (2) a silylene group or an oligosilylene group, which may have a lower-alkyl or phenyl side-chain substituent, such as a silylene group, a dimethyl silylene group, a methylphenyl silylene group, a diphenyl silylene group, a disilylene group, or a tetramethyl disilylene group, and (3) a hydrocarbon group [a lower alkyl group, a phenyl group, a hydrocarbyloxy group (preferably a lower alkoxy group), etc.] containing germanium, phosphorus, nitrogen, boron, or aluminum, such as a $(CH_3)_2$ Ge group, a $(C_6H_5)_2$ Ge group, a $(CH_3)$ P group, a $(C_6H_5)$ P group, a $(C_4H_9)$ N group, a $(C_6H_5)$ N group, a $(CH_3)$ B group, a $(C_4H_9)$ B group, a $(C_6H_5)$ B group, a $(C_6H_5)$ Al group, or a $(CH_3O)$ Al group. Among them, an alkylene group and a silylene group are preferred from the viewpoint of catalytic activity.

$(C_5H_{5-a-b}R^3_b)$, $(C_5H_{5-a-c}R^4_c)$ and $(C_5H_{5-a-d}R^5_d)$ are conjugated five-membered ring ligands, in which $R^3$, $R^4$ and $R^5$ each represent a hydrocarbon group, a halogen atom, an alkoxy group, a silicon-containing hydrocarbon group, a phosphorus-containing hydrocarbon group, a nitrogen-containing hydrocarbon group, or a boron-containing hydrocarbon group. a is 0, 1 or 2. b, c, and d each represent an integer of 0 to 5 when a=0, an integer of 0 to 4 when a=1, and an integer of 0 to 3 when a=2. The hydrocarbon group preferably has 1 to 20 carbon atoms, particularly preferably has 1 to 12 carbon atoms. The hydrocarbon group may be a monovalent group and may bind to a cyclopentadienyl group which is a conjugated five-membered ring group. Alternatively, when a plurality of hydrocarbon groups is present, two of them may be bound to each other to form a ring structure together with part of a cyclopentadienyl group.

Thus, the conjugated five-membered ring ligands are typified by a cyclopentadienyl group, an indenyl group or a fluorenyl group, which may or may not be substituted. Examples of the halogen atom include a chlorine atom, a bromine atom, an iodine atom, and a fluorine atom. The alkoxy group is preferably one having 1 to 12 carbon atoms. The silicon-containing hydrocarbon group may be, for example, —$Si(R^6)(R^7)(R^8)$ ($R^6$, $R^7$ and $R^8$ are each a hydrocarbon group having 1 to 24 carbon atoms). The phosphorus-containing hydrocarbon group, the nitrogen-containing hydrocarbon group, and the boron-containing hydrocarbon group may be, for example, —$P(R^9)(R^{10})$, —$N(R^9)(R^{10})$, and —$B(R^9)(R^{10})$ ($R^9$ and $R^{10}$ are each a hydrocarbon group having 1 to 18 carbon atoms), respectively.

When there are a plurality of $R^3$s, a plurality of $R^4$s, and a plurality of $R^5$s, the $R^3$s, $R^4$s and $R^5$s may each be the same or different from each other. Further, in the general formula (2), the conjugated five-membered ring ligands $(C_5H_{5-a-b}R^3_b)$ and $(C_5H_{5-a-c}R^4_c)$ may be the same or different from each other.

The hydrocarbon group having 1 to 24 carbon atoms or the hydrocarbon group having 1 to 18 carbon atoms include an alkyl group, an alkenyl group, an aryl group, and an alicyclic aliphatic hydrocarbon group. The alkyl group includes a methyl group, an ethyl group, a n-propyl group, an isopropyl group, a n-butyl group, an isobutyl group, a tert-butyl group, a n-hexyl group, and a n-decyl group. The alkyl group preferably has 1 to 20 carbon atoms. The alkenyl group includes a vinyl group, a 1-propenyl group, a 1-butenyl group, a 1-hexenyl group, a 1-octenyl group, and a cyclohexenyl group. In the present invention, the alkenyl group preferably has 2 to 10 carbon atoms. The aryl group includes a phenyl group, a tolyl group, a xylyl group, and a naphthyl group. In the present invention, the aryl group preferably has 6 to 14 carbon atoms. The alicyclic aliphatic hydrocarbon group includes a cyclopropyl group, a cyclopentyl group, and a cyclohexyl group.

$M^1$ represents a transition metal belonging to Groups 4 to 6 of the Periodic Table. Specific examples of the transition metal include titanium, zirconium, hafnium, vanadium, niobium, molybdenum, and tungsten. Among them, titanium, zirconium, and hafnium are preferred from the viewpoint of catalytic activity. Z is a covalent ligand, and examples include a halogen atom, oxygen (—O—), sulfur (—S—), an alkoxy group having 1 to 20 (preferably 1 to 10) carbon atoms, a thioalkoxy group having 1 to 20 (preferably 1 to 12) carbon atoms, a nitrogen-containing hydrocarbon group (e.g., a t-butylamino group or a t-butylimino group) having 1 to 40 (preferably 1 to 18) carbon atoms, and a phosphorus-containing hydrocarbon groups having 1 to 40 (preferably 1 to 18) carbon atoms. X and Y are each a covalent or combinative ligand, and examples include a hydrogen atom, a halogen atom, a hydrocarbon group having 1 to 20 (preferably 1 to 10) carbon atoms, an alkoxy group having 1 to 20 (preferably 1 to 10) carbon atoms, an amino group, a phosphorus-containing hydrocarbon group (e.g., a diphenylphosphine group) having 1 to 20 (preferably 1 to 12) carbon atoms, a silicon-containing hydrocarbon group (e.g., a trimethylsilyl group) having 1 to 20 (preferably 1 to 12) carbon atoms, and a boron compound (e.g., $B(C_6H_5)_4$ or $BF_4$) containing a hydrocarbon group having 1 to 20 (preferably 1 to 12) carbon atoms or a halogen. Among them, a halogen atom and a hydrocarbon group are preferred. The X and the Y may be the same or different from each other. Among the transition metal compounds represented by the general formula (2) or (3), a complex having a ligand with an indenyl, cyclopentadienyl or fluorenyl structure is particularly preferred.

Examples of the transition metal compound represented by the general formula (2) or (3) include (a) a transition metal compound having no crosslinking group and having two conjugated five-membered ring ligands, (b) a transition metal compound having two conjugated five-membered ring ligands crosslinked by an alkylene group, (c) a transition metal compound having two conjugated five-membered ring ligands crosslinked by a silylene group, (d) a transition metal compound having two conjugated five-membered ring ligands crosslinked by a hydrocarbon group containing germanium, aluminum, boron, phosphorus, or nitrogen, (e) a transition metal compound having one conjugated five-membered ring ligand, (f) a transition metal compound having two conjugated five-membered ring ligands which are double-crosslinked, and (g) a transition metal compound corresponding to any one of the above-described compounds (a) to (f) in which a chlorine atom(s) is replaced with a bromine atom, an iodine atom, a hydrogen atom, a methyl group, a phenyl group, a benzyl group, a methoxy group, a dimethylamino group, or the like.

Among the compounds (a) to (g), the compound (c), namely the transition metal compound having two conjugated five-membered ring ligands crosslinked by a silylene group, in which the transition metal is zirconium or titanium, is preferred.

There is no particular limitation on the compound (ii-1), namely the compound composed of a cation and an anion in which a plurality of groups are bound to an element, of the component (ii) constituting the catalyst; however, compounds represented by the following formula (4) or (5) can be preferably used:

$$([L^1-R^{11}]^{k+})_p[M^2Z^1Z^2\ldots Z^n]_q^{(n-m)-} \quad (4)$$

$$([L^2]^{k+})_p[M^3Z^1Z^2\ldots Z^n]_q^{(n-m)-} \quad (5)$$

where $L^2$ is $M^4$, $R^{12}R^{13}M^5$, $R^{14}{}_3C$, $R^{15}R^{16}R^{17}R^{18}N$ or $R^{19}R^{20}R^{21}S$. $L^1$ represents a Lewis base, and $R^{11}$ represents a hydrogen atom, an alkyl group having 1 to 20 carbon atoms, an aryl group having 6 to 20 carbon atoms, an alkylaryl group or an arylalkyl group. $M^2$ and $M^3$ are each an element selected from Group 13, Group 14, Group 15, Group 16, and Group 17 of the Periodic Table. $Z^1$ to $Z^n$ each represent a hydrogen atom, a dialkylamino group, an alkoxy group having 1 to 20 carbon atoms, an aryloxy group having 6 to 20 carbon atoms, an alkyl group having 1 to 20 carbon atoms, an aryl group having 6 to 20 carbon atoms, an alkylaryl group, an arylalkyl group, a halogen-substituted hydrocarbon group having 1 to 20 carbon atoms, an acyloxy group having 1 to 20 carbon atoms, an organometalloid group or a halogen atom. Two or more of $Z^1$ to $Z^n$ may bind together to form a ring.

m represents the valence of each of $M^2$ and $M^3$ and is an integer of 1 to 7, n is an integer of 2 to 8, k represents the ion valence of each of $[L^1\text{-}R^{11}]$ and $[L^2]$ and is an integer of 1 to 7, p is an integer equal to or greater than 1, and $q=(p\times k)/(n-m)$.

$M^4$ represents an element selected from Groups 1 and 11 of the Periodic Table, $M^5$ represents an element selected from Group 8, Group 9, and Group 10 of the Periodic Table, $R^{12}$ and $R^{13}$ each represent a cyclopentadienyl group, a substituted cyclopentadienyl group, an indenyl group or a fluorenyl group, $R^{14}$ represents an alkyl group having 1 to 20 carbon atoms, an aryl group, an alkylaryl group or an arylalkyl group. $R^{15}$ to $R^{21}$ each represent a hydrogen atom, a halogen atom, an alkyl group having 1 to 20 carbon atoms, an aryl group having 6 to 20 carbon atoms, an alkylaryl group, an arylalkyl group, a substituted alkyl group or an organometalloid group.

Specific examples of the Lewis base ($L^1$) include: ammonia; amines such as methylamine, aniline, dimethylamine, diethylamine, N-methylaniline, diphenylamine, trimethylamine, triethylamine, tri-n-butylamine, N,N-dimethylaniline, methyldiphenylamine, pyridine, p-bromo-N,N-dimethylaniline, and p-nitro-N,N-dimethylaniline; phosphines such as triethyl phosphine, triphenyl phosphine, and diphenyl phosphine; ethers such as dimethyl ether, diethyl ether, tetrahydrofuran, and dioxane; thioethers such as diethyl thioether and tetrahydrothiophene; and ester such as ethyl benzoate.

$M^2$ and $M^3$ are each exemplified by B and Al. $M^4$ is exemplified by Na, Ag and Cu. $M^5$ is exemplified by Fe and Co.

Among the compounds represented by the general formula (4) or (5), compounds in which $M^2$ or $M^3$ is boron are preferred, and compounds represented by the general formula (4) in which $M^2$ is boron are especially preferred.

The organoaluminum compound (ii-2) of the component (ii), constituting the catalyst, includes compounds represented by the following formula (6), (7) or (8).

$$R^{22}_{r}AlQ^3_{3-r} \tag{6}$$

where $R^{22}$ represents a hydrocarbon group such as an alkyl group having 1 to 20 (preferably 1 to 12) carbon atoms, an alkenyl group, an aryl group, or an aryl alkyl group, $Q^3$ represents a hydrogen atom, an alkoxy group having 1 to 20 carbon atoms, or a halogen atom, and r is a numeral of 1 to 3.

A linear aluminoxane represented by the formula:

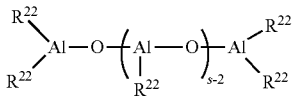

(7)

where $R^{22}$ is the same as the one described above, and s represents the degree of polymerization, which is generally 3 to 50.

A cyclic alkylaluminoxane represented by the formula:

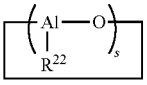

(8)

where $R^{22}$ is the same as the one described above, and s represents the degree of polymerization, which is preferably 3 to 50.

The catalyst for use in the present invention includes a catalyst mainly containing the component (i) and the component (ii-1), a catalyst mainly containing the component (i) and the component (ii-2), and a catalyst mainly containing the component (i), the component (ii-1), and the component (ii-2). When the component (ii-1) is used, no limitation is placed on conditions for use of the component (i) and the component (ii-1). However, it is preferred that the ratio (molar ratio) between the component (i) and the component (ii-1) be 1:0.01 to 1:100, particularly 1:1 to 1:10. The catalyst is preferably used at a temperature in the range of −100° C. to 250° C., while the pressure and the processing time can be arbitrarily set. When the component (ii-2) is used, the amount of the component (ii-2) is generally 1 to 1000 mols, preferably 3 to 600 mols per mol of the component (i). The use of the component (ii-2) can enhance the catalytic activity; however, the use of the component (ii-2) in a too large amount will lead to a waste of the organoaluminum compound. The component (i) and the component (ii-1) may be brought into contact with each other in advance, followed by isolation and washing of the contact product before use. Alternatively, the component (i) and the component (ii-1) may be brought into contact with each other in a reaction system. The component (ii-2) may be brought into contact with the component (i), with the component (ii-1), or with a contact product between the component (i) and the component (ii-1). The contact may be performed in advance or in a reaction system.

[Acid Catalyst]

The acid catalyst includes a Friedel-Crafts catalyst, a solid acid catalyst, a Lewis acid catalyst, and a Bronsted acid catalyst. Among them, a Friedel-Crafts catalyst is preferred.

The Friedel-Crafts catalyst preferably contains an organoaluminum compound, and more preferably contains an organoaluminum compound and an organic halide.

The organoaluminum compound may be a trialkylaluminum, a dialkylaluminum halide, an alkylaluminum dihalide, or the like. A dialkylaluminum halide is preferred.

Specific examples of the organoaluminum compound include trimethylaluminum, triethylaluminum, triisobutylaluminum, diethylaluminum chloride, ethylaluminum sesquichloride, and ethylaluminum dichloride. Among them, diethylaluminum chloride is preferred.

The organic halide may be an alkyl halide or an aryl halide. An alkyl halide is preferred.

Specific examples of the alkyl halide include t-butyl chloride, sec-butyl chloride, cyclohexyl chloride, and 2,5-dimethyl-2-chlorohexane. t-butyl chloride is preferred.

The molar ratio between the organoaluminum compound and the organic halide (organoaluminum compound/organic halide) used in the present producing method is preferably 1/10 to 1/0.5, more preferably 1/5 to 1/1, and still more preferably ¼ to ½. When the ratio is 1/10 or more, the halogen amount of the resulting oligomer can be reduced, leading to easy removal of halogen. When the ratio is 1/0.5 or less, the reaction can be performed with high reproducibility.

The concentration of the Friedel-Crafts catalyst used in the present producing method, as determined in terms of the molar amount of aluminum per volume of the substrate (α-olefins used in the reaction as raw materials for poly-α-olefins, vinylidene olefins, and polymer of olefins) at 25° C., is preferably 0.5 to 50 mmol/L, more preferably 0.6 to 20 mmol/L, still more preferably 0.8 to 10 mmol/L, and even still more preferably 1 to 5 mmol/L. When the concentration of the catalyst is 0.5 mmol/L or more, the reaction can be performed with high reproducibility. When the concentration of the catalyst is 50 mmol/L or less, the halogen amount of the resulting oligomer can be reduced, leading to easy removal of halogen.

[(3) a Method of Hydrogenating a Product Obtained by Polymerizing α-Olefin with a Metallocene Catalyst and Further Polymerizing the Polymerized Product with an Acid Catalyst]

Among the methods of producing the poly-α-olefins, (3) A method of hydrogenating a product obtained by polymerizing an α-olefin with a metallocene catalyst and further polymerizing the polymerized product with an acid catalyst, which is a more preferable embodiment, will be described.

Among these methods, a method of hydrogenating a product obtained by polymerizing an α-olefin with a metallocene catalyst and further dimerizing the polymerized product with an acid catalyst, is more preferable. A method of hydrogenating a product obtained by dimerizing an α-olefin with a metallocene catalyst and further dimerizing the polymerized product with an acid catalyst, is still more preferable.

<<Step of Polymerizing α-Olefin with Metallocene Catalyst>>

The polymerization of an α-olefin or the dimerization reaction of an α-olefin is carried out by being stirred in the presence of the α-olefin and the metallocene catalyst, optionally in a hydrocarbon solvent, at a temperature of 200° C. or lower, preferably 10 to 100° C., for 4 to 200 hours, preferably 8 to 100 hours. The reaction pressure is usually ordinary pressure or increased pressure. After completion of the reaction, the catalyst is deactivated with a compound having a hydroxy group (e.g., methanol), and then optionally washed with an acid (e.g., an aqueous hydrochloric acid solution or sulfuric acid), followed by vacuum distillation of the product (oil) to obtain a polymer (preferably a dimer) with high purity and high yield. The hydrocarbon solvent may be an aromatic hydrocarbon such as benzene, toluene, xylene, ethylbenzene, cumene, or cymene; an aliphatic hydrocarbon such as pentane, hexane, heptane, octane, decane, dodecane, hexadecane, or octadecane; an alicyclic hydrocarbon such as cyclopentane, cyclohexane, cyclooctane, or methylcyclopentane; or a halogenated hydrocarbon such as chloroform or dichloromethane. These solvents may be used singly or in a combination of two or more.

When obtaining a dimer in this step, the dimer is preferably vinylidene olefin.

The vinylidene olefin is preferably at least one selected from compounds represented by the following general formula (1):

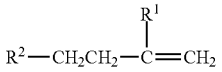

(1)

where $R^1$ and $R^2$ each independently represent a hydrogen atom or a linear or branched alkyl group having 1 to 16 carbon atoms.

In the general formula (1), $R^1$ and $R^2$ are each independently a hydrogen atom or a linear or branched alkyl group having 1 to 16 carbon atoms, and are preferably a linear alkyl group having 8 to 16 carbon atoms in the present invention. As the linear alkyl group having 8 to 16 carbon atoms, a n-octyl group, a n-nonyl group, a n-decyl group, a n-undecyl group, a n-dodecyl group, a n-tridecyl group, a n-tetradecyl group, a n-pentadecyl group, and a n-hexadecyl group, are given.

As described above, the vinylidene olefin can be produced by dimerizing an α-olefin.

Here, the α-olefins described in the above-mentioned item of "[α-olefin]" can be preferably used as an α-olefin. Among them, α-olefins having 6 to 12 carbon atoms are preferred, and α-olefins having 8 to 10 carbon atoms are more preferred. Further, linear α-olefins are preferred, linear α-olefins having 6 to 12 carbon atoms are more preferred, and linear α-olefins having 8 to 10 carbon atoms are even more preferred.

Specific examples of the α-olefin include 1-octene, 1-decene, 1-dodecene, 1-tridecene, 1-tetradecene, 1-pentadecene, 1-hexadecene, 1-heptadecene, and 1-octadecene. 1-octene, 1-decene, 1-dodecene, and 1-tetradecene are preferred, 1-octene and 1-decene are more preferred, and 1-decene is even more preferred. These α-olefins may be used singly or in a combination of two or more.

Specifically, as the vinylidene olefin used in this step, a dimer of 1-octene, a dimer of 1-decene, a dimer of 1-dodecene, and a dimer of 1-tetradecene, are preferable, a dimer of 1-octene and a dimer of 1-decene, are more preferable, a dimer of 1-decene is more preferable.

<<Step of Polymerizing with Acid Catalyst>>

This step is a step of further polymerizing the polymerized product of α-olefin with a metallocene catalyst as described above, using an acid catalyst. It is preferably a step of dimerizing with an acid catalyst.

In this step, the acid catalyst described above is used.

Preferably, prior to initiating the reaction in this step, a treatment is performed to remove moisture, an oxidation product, etc., in the polymer (preferably a dimer) of the α-olefin. The treatment may be performed, for example, by a method which involves putting an adsorbent in the polymer for adsorption removal of moisture, etc., or a method which involves bubbling an inert gas or a dried gas into the polymer to remove moisture, etc. with a gas flow. Such methods are preferably used in combination.

Activated alumina or a molecular sieve is preferably used as the adsorbent.

Nitrogen gas is preferably used as a bubbling gas.

The polymer used in this step is preferably the vinylidene olefin, which is a dimer of α-olefin, and an α-olefin may be used at the same time in order to adjust the molecular weight depending on the application.

The polymerization reaction (preferably a dimerization reaction) is allowed to proceed through contact between the catalyst and the olefin.

The reaction temperature upon the polymerization reaction is preferably 0 to 100° C., more preferably 25 to 95° C., and even more preferably 30 to 80° C. When the reaction temperature is 0° C. or more, the time until the initiation of the reaction can be reduced and, in addition, the reaction can be performed with high reproducibility. When the reaction temperature is 100° C. or less, the intended polymer can be obtained at a high yield without deactivation of the catalyst and a side reaction such as isomerization of the olefin.

The reaction is an exothermic reaction; therefore, the reaction temperature increases during the reaction. The maximum reaction temperature is preferably adjusted to be within the above range. The end point of the reaction can be determined by detection of no generation of heat.

<<Hydrogenation Step>>

This step is a step of hydrogenating the polymer obtained by polymerizing with an acid catalyst.

In this hydrogenating step, the intended poly-α-olefin is preferably produced by gas-phase hydrogenation of the above-described polymer using a hydrogenation catalyst.

A common gas-phase hydrogenation method can be used in the hydrogenation step. When a noble metal catalyst, such as palladium or platinum, is used as the hydrogenation catalyst, the reaction is preferably carried out at a reaction temperature of 60 to 100° C. and a hydrogen pressure of 0.1 to 1 MPa. When a nickel catalyst is used, the reaction is preferably carried out at a reaction temperature of 150 to 250° C. and a hydrogen pressure of 1 to 20 MPa. In either system, the catalytic amount is generally 0.05 to 50% by mass with respect to the polymer, and the hydrogenation reaction is complete in 2 to 48 hours. The hydrogenation reaction proceeds rapidly by using the above-described hydrogenation catalyst. An additional operation, e.g., to raise the temperature or pressure of the reaction system, may be carried out even after noticeable hydrogen absorption ceases in order to completely perform hydrogenation of a small amount of residual unsaturated poly-α-olefin.

<<Distillation Step>>

In the present producing method, a further distillation step is preferably contained.

It is preferred to perform the present distillation step in order to remove impurities, raw materials or a poly-α-olefin having an unintended molecular weight.

The conditions of the distillation may be appropriately changed e.g., depending on the molecular weight of the intended poly-α-olefin.

[(1) Method of Hydrogenating a Product Obtained by Polymerizing an α-Olefin with a Metallocene Catalyst]

In the method of hydrogenating a product obtained by polymerizing an α-olefin with a metallocene catalyst, an α-olefin is polymerized in the presence of a metallocene catalyst until it reaches the intended molecular weight (degree of polymerization), and the obtained polymer is hydrogenated to obtain the intended poly-α-olefin.

In this method, the step of polymerizing an α-olefin with a metallocene catalyst is preferably according to the method described in the above-mentioned item of <<Step of polymerizing α-olefin with metallocene catalyst>> of [(3) a method of hydrogenating a product obtained by polymerizing an α-olefin with a metallocene catalyst and further polymerizing the polymerized product with an acid catalyst]. Note that in this method, the polymerization is carried out until the intended molecular weight (degree of polymerization) is reached in one step reaction.

Next, the obtained polymer is hydrogenated. The hydrogenation step is preferably according to the method described in the above-mentioned item of <<Hydrogenation step>> of the above [(3) a method of hydrogenating a product obtained by polymerizing an α-olefin with a metallocene catalyst and further polymerizing the polymerized product with an acid catalyst].

In this method, it is preferable to further include the distillation process shown in the above-mentioned item of <<Distillation step>>.

[(2) a Method of Hydrogenating a Product Obtained by Polymerizing an α-Olefin with an Acid Catalyst]

In the method of hydrogenating a product obtained by polymerizing an α-olefin with an acid catalyst, the α-olefin is polymerized in the presence of an acid catalyst until it reaches the intended molecular weight (degree of polymerization), and obtained polymer is hydrogenated to obtain the intended poly-α-olefin.

In this method, the step of polymerizing an α-olefin by an acid catalyst is preferably according to the method described in the above-mentioned item of <<Step of polymerizing α-olefin with acid catalyst>> of [(3) a method of hydrogenating a product obtained by polymerizing an α-olefin with a metallocene catalyst and further polymerizing the polymerized product with an acid catalyst]. Note that in this method, the polymerization is carried out until the desired molecular weight (degree of polymerization) is reached in one step reaction.

Next, the obtained polymer is hydrogenated. The hydrogenation step is preferably according to the method described in the above-mentioned item of <<Hydrogenation step>> of the above [(3) a method of hydrogenating a product obtained by polymerizing an α-olefin with a metallocene catalyst and further polymerizing the polymerized product with an acid catalyst].

In the present method, it is preferable to further include the distillation process shown in the above-mentioned item of <<Distillation process>>.

[Characteristics, Etc., of Poly-α-Olefin]

As described above, the poly-α-olefin contained in the lubricating oil composition of the present invention is preferably a polymerized product of an α-olefin having 6 to 12 carbon atoms, more preferably a polymerized product of an α-olefin having 8 to 12 carbon atoms, still more preferably a polymerized product of an α-olefin having 8 to 10 carbon atoms.

Further, the poly-α-olefin is preferably a product by dimerizing an α-olefin with a metallocene catalyst and further dimerizing the dimerized product with an acid catalyst, and more preferably a product obtained by dimerizing an α-olefin with a metallocene catalyst, further dimerizing the dimerized product with an acid catalysis, and then performing a hydrogenation.

That is, it is preferably a tetramer of α-olefin having 6 to 12 carbon atoms, more preferably a tetramer of α-olefin having 8 to 12 carbon atoms, and still more preferably a tetramer of α-olefin having 8 to 10 carbon atoms. Furthermore, it is preferably a hydrogenated product of a tetramer of α-olefin having 6 to 12 carbon atoms, more preferably a hydrogenated product of a tetramer of α-olefin having 8 to 12 carbon atoms, and still more preferably a hydrogenated product of a tetramer of α-olefin having 8 to 10 carbon atoms.

As the α-olefin, 1-decene is preferable. Therefore, it is preferably a tetramer of 1-decene, more preferably a hydrogenated product of tetramer of 1-decene.

The poly-α-olefin contained in the lubricating oil composition of the present invention preferably contains a compound represented by the following general formula (9), more preferably contains a compound represented by the following general formula as a main ingredient.

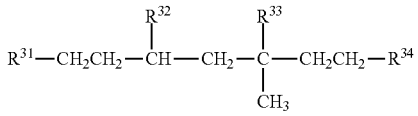

(9)

where, $R^{31}$ to $R^{34}$ each independently represent a hydrogen atom or a linear or branched alkyl group having 1 to 16 carbon atoms.

In the general formula (9), $R^{31}$ to $R^{34}$ are each independently a hydrogen atom or a linear or branched alkyl group having 1 to 16 carbon atoms, however in the present invention, it is preferably a linear alkyl group having 8 to 16 carbon atoms. As the linear alkyl group having 8 to 16 carbon atoms, n-octyl groups, n-nonyl groups, n-decyl groups, n-undecyl groups, n-dodecyl groups, n-tridecyl group, n-tetradecyl group, n-pentadecyl group and n-hexadecyl group, are given, and n-octyl group is more preferable. In the general formula (9), $R^{31}$ to $R^{34}$ are more preferably n-octyl groups, and the poly-α-olefin is still more preferably 11-methyl-11,13-dioctyltricosane.

The poly-α-olefin contained in the lubricating oil composition of the present invention more preferably contains the compound represented by the general formula (9) as a main ingredient, and still more preferably contains 50% by mass or more of the compound represented by the formula (9).

By the poly-α-olefin contained in the lubricating oil composition of the present invention containing the compound having the above structure, the lubricating oil composition of the present invention can have the lower values for both evaporation loss by the Noack method and kinematic viscosity.

[Average Carbon Number of Poly-α-Olefin]

The average carbon number of the poly-α-olefin in the lubricating oil composition of the present invention is preferably from 36 to 44, more preferably from 38 to 42, still more preferably from 39 to 42 and even still more preferably from 39 to 41. When the average carbon number of the poly-α-olefin is in the above-mentioned range, the kinematic viscosity can be easily adjusted to the range of the present invention and the evaporation loss by the Noack method can also be adjusted to the range of the present invention, therefore it can be used as a base oil for a lubricating oil composition suitable for long-term use.

<Antioxidant>.

The lubricating oil composition of the present invention contains an antioxidant, and the amount of the antioxidant with respect to the poly-α-olefin is 0.05% by mass or more.

The antioxidants contained in the lubricating oil composition of the present invention are not limited as long as they are compatible with the base oil, but those described below are suitably used.

An oxidative decomposition of the lubricating oil is considered to be based on a mechanism in which the thermal radicals generated by temperature rise react with oxygen in the air. Therefore, from the viewpoint of capturing the generated thermal radicals, the antioxidant contained in the lubricating oil composition of the present invention is preferably selected from the group consisting of phenolic antioxidants, amine antioxidants, and zinc dialkyldithiophosphate, more preferably at least one selected from the group consisting of phenolic antioxidants and amine antioxidants, and still more preferably phenolic antioxidants.

Among the phenolic antioxidants, tetrakis[methylene-3-(3',5-di-t-butyl-4'-hydroxyphenyl)propionate]methane is preferable. Thus, the antioxidant contained in the lubricating oil composition of the present invention is more preferably tetrakis[methylene-3-(3',5-di-t-butyl-4'-hydroxyphenyl)propionate]methane.

In addition, a plurality of these antioxidants may be combined, and these antioxidants may be combined with an antioxidant having a peroxide decomposition function.

As the antioxidant having a peroxide decomposition function, organic sulfur antioxidants, and zinc dialkyldithiophosphate has both radical scavenging function and peroxide decomposition function.

The antioxidant contained in the lubricating oil composition of the present invention preferably has a high boiling point since its volatility affects Noack. Specifically, the boiling point of the antioxidant is preferably 250° C. or higher, more preferably 300° C. or higher.

Also, the amount of the antioxidant contained in the lubricating oil composition of the present invention is 0.05% by mass or more with respect to the poly-α-olefin. "0.05% by mass or more with respect to the poly-α-olefin" means that "the amount of the antioxidant is 0.05 parts by mass when the poly-α-olefin is 100 parts by mass."

The amount of the antioxidant contained in the lubricating oil composition of the present invention is preferably 0.1% by mass or more, more preferably 0.2% by mass or more, still more preferably 0.3% by mass or more, and even still more preferably 0.4% by mass or more, with respect to the poly-α-olefin.

When the amount of the antioxidant is in the above range, the effect of reducing the evaporation loss by the Noack method is sufficiently obtained, therefore it is possible to make the lubricating oil composition have a low viscosity and a small evaporation loss and suitable for long-term use.

On the other hand, the amount of the antioxidant contained in the lubricating oil composition of the present invention is preferably 10% by mass or less with respect to the poly-α-olefin. When the amount of the antioxidant is less than the upper limit, the cost of the antioxidant can also be reduced. From the above viewpoint, the amount of the antioxidant contained in the lubricating oil composition of the present invention may be 5% by mass or less, or 3% by mass or less, with respect to the poly-α-olefin.

<Characteristics of Lubricating Oil Composition, Additives, Etc.>

As described above, the lubricating oil composition of the present invention contains a poly-α-olefin and an antioxidant, and the amount of the antioxidant with respect to the poly-α-olefin is 0.05% by mass or more. Furthermore, the evaporation loss by the Noack method is 4.9% by mass or less, and the kinematic viscosity at 100° C. is 6.5 $mm^2$/sec or less.

By having such properties, it is possible to make the lubricating oil composition suitable for long-term use.

The evaporation loss by the Noack method of the lubricating oil composition of the present invention is 4.9% by mass or less, preferably 4.3% by mass or less, more preferably 4.0% by mass or less, still more preferably 3.5% by mass or less, even still more preferably 3.0% by mass or less, and even still more preferably 2.5% by mass or less.

The kinematic viscosity at 100° C. of the lubricating oil composition of the present invention is 6.5 $mm^2$/sec or less, preferably 6.3 $mm^2$/sec or less, more preferably 6.1 $mm^2$/sec or less, and still more preferably 6.0 $mm^2$/sec or less. A preferable lower limit of kinematic viscosity at 100° C. varies depending on the use of the lubricating oil, however in the lubricating oil composition of the present invention, it is preferably 5.0 $mm^2$/sec or more.

Various additives can be used in the lubricating oil composition of the present invention as long as the effect of the present invention is not impaired.

Examples of the additives include a viscosity index improver, an antiwear agent, an oily agent, an extreme-pressure agent, a detergent-dispersant, a rust inhibitor, a metal deactivator, and an antifoaming agent.

Examples of the viscosity index improver include polymethacrylate, dispersed polymethacrylate, an olefin copolymer (e.g., an ethylene-propylene copolymer), a dispersed olefin copolymer, and a styrene copolymer (e.g., a hydrogenated styrene-diene copolymer), etc. The amount of the viscosity index improver is generally about 0.5 to 35% by mass, preferably 1 to 15% by mass based on the total amount of the lubricating oil composition from the viewpoint of the effect of the agent.

As the antiwear agents, sulfur-containing compounds such as zinc dialkyldithiophosphate (ZnDTP), zinc phosphate, disulfides, sulfurized olefins, sulfurized oils and fats, sulfurized esters, thiocarbonates, thiocarbamates, and polysulfides; phosphorus-containing compounds such as phosphites, phosphates, phosphonates, and their amine salts or metal salts; sulfur- and phosphorus-containing antiwear agents such as thiophosphites, thiophosphates, thiophosphonates, and their amine salts or metal salts, are given.

The blending amount of the antiwear agent is usually about 0.01 to 30% by mass, more preferably 0.01 to 10% by mass, based on the total amount of the lubricating oil composition, from the viewpoint of the effect of the agent and economy.

The oily agent includes an aliphatic alcohol, a fatty acid compound such as a fatty acid and a fatty acid metal salt, an ester compound such as a polyol ester, a sorbitan ester and a glyceride, and an amine compound such as an aliphatic amine.

The amount of the oily agent is generally about 0.1 to 30% by mass, preferably 0.5 to 10% by mass based on the total amount of the lubricating oil from the viewpoint of the effect of the agent.

The extreme-pressure agent includes a sulfur extreme-pressure agent, a phosphorus extreme-pressure agent, an extreme-pressure agent containing sulfur and a metal, and an extreme-pressure agent containing phosphorus and a metal. These extreme-pressure agents may be used singly or in a combination of two or more. Any extreme-pressure agent may be used as long as it contains a sulfur atom and/or a phosphorus atom in the molecule and can achieve good load bearing properties and wear resistance.

The amount of the extreme-pressure agent is generally about 0.01 to 30% by mass, preferably 0.01 to 10% by mass based on the total amount of the lubricating oil composition from the viewpoint of economy and the effect of the agent.

The detergent-dispersant includes a metal sulfonate, a metal salicylate, a metal phenate, a succinic imide, etc. The amount of the detergent-dispersant is generally about 0.1 to 30% by mass, preferably 0.5 to 10% by mass based on the total amount of the lubricating oil composition from the viewpoint of the effect of the agent.

The rust inhibitor includes a metal sulfonate and a succinic acid ester, etc. The amount of the rust inhibitor is generally about 0.01 to 10% by mass, preferably 0.05 to 5% by mass based on the total amount of the lubricating oil composition from the viewpoint of the effect of the agent.

The metal deactivator includes benzotriazole, thiadiazole, etc. The amount of the metal deactivator is generally about 0.01 to 10% by mass, preferably 0.01 to 1% by mass based on the total amount of the lubricating oil composition from the viewpoint of the effect of the agent.

The antifoaming agent includes a methyl silicone oil, a fluorosilicone oil, polyacrylate, etc. The amount of the antifoaming agent is generally about 0.0005 to 0.01% by mass based on the total amount of the lubricating oil composition from the viewpoint of the effect of the agent.

When the lubricating oil composition of the present invention is used as a lubricating oil, other base oils can be used in combination depending on the application within a range that does not impair the object of the present invention. Other base oils can be appropriately selected from the mineral oils and the synthetic oils.

When the lubricating oil composition of the present invention is used in the lubricating oil, the amount of the lubricating oil composition of the present invention is preferably 55% by mass or more, more preferably 60% by mass or more, still more preferably 80% by mass or more, in the lubricating oil. Moreover, it is 100% by mass or less, and may contain only of the lubricating oil composition of the present invention. When it is within the above range, the effects of the present invention are sufficiently exhibited, the base oil does not volatilize, weight reduction is suppressed, and the number of oil changes can be reduced.

<Method of Producing Lubricating Oil Composition>

As long as the lubricating oil composition of the present invention contains a poly-α-olefin and an antioxidant, and in which an evaporation loss by the Noack method is 4.9% by mass or less, a kinematic viscosity at 100° C. is 6.5 $mm^2$/sec or less, and an amount of the antioxidant with respect to the poly-α-olefin is 0.05% by mass or more, as described above, the producing method is not limited. However, it is preferably obtained by a producing method of following the production of poly-α-olefin and having steps of adding the above-mentioned antioxidant in the poly-α-olefin and dissolving it. That is, a preferable producing method of the lubricating oil composition of the present invention is (1) a producing method of hydrogenating (hydrogenation) after polymerizing α-olefin with a metallocene catalyst or an acid catalyst, to obtain a poly-α-olefin, and adding an antioxidant in the obtained poly-α-olefin and dissolving it. A more preferable producing method is a producing method of hydrogenating after polymerizing an α-olefin with a metallocene catalyst and further polymerizing the polymerized product with an acid catalyst, to obtain the poly-α-olefin, and adding an antioxidant in the obtained poly-α-olefin, and dissolving it.

The method for obtaining the poly-α-olefin in this producing method is preferably the method described in the above-described method for producing the poly-α-olefin, and the suitable method is also the same.

In addition, the antioxidant in this producing method is preferably the antioxidant described above, and the suitable antioxidant is also the same.

In the step of adding the antioxidant in the poly-α-olefin and dissolving it, the various additives described above can be used within the range that does not impair the effects of the present invention.

[Evaporation Loss Reduction Method of Lubricating Oil]

The evaporation loss reduction method of the lubricating oil of the present invention is a method by adding 0.05% by mass or more of an antioxidant with respect to a lubricant base oil which is a poly-α-olefin, so that the evaporation loss by the Noack method is 66% or less of that before adding the antioxidant.

In this method, the poly-α-olefin is used as the base oil of the lubricating oil. The evaporation loss can be reduced by using a chemically stable poly-α-olefin as the lubricant base oil.

As the poly-α-olefin used in this method is the poly-α-olefin described in the above-mentioned item of <Poly-α-olefin> of [Lubricant Composition], and suitable poly-α-olefins are the same. Among them, the poly-α-olefin preferably has an average carbon number of 36 to 44.

The lubricating oil used in this method can be used in combination with a base oil other than poly-α-olefin depending on the application, as long as the object of the present invention is not impaired. Other base oils can be appropriately selected from mineral oils and synthetic oils.

The amount of the poly-α-olefin in the base oil of the lubricating oil is preferably 55% by mass or more, more preferably 60% by mass or more, and still more preferably 80% by mass or more. Further, the amount is 100% by mass or less, and the base oil of the lubricating oil may contain only poly-α-olefin.

In this method, 0.05% by mass or more of an antioxidant is added to a lubricant base oil which is a poly-α-olefin.

An oxidative decomposition of lubricating oil is considered to be based on a mechanism in which thermal radicals generated by temperature rise react with oxygen in the air. Therefore, from the viewpoint of capturing the generated thermal radicals, the antioxidant contained in the lubricating oil composition of the present invention is preferably selected from the group consisting of phenolic antioxidants, amine antioxidants, and zinc dialkyldithiophosphate, more preferably at least one selected from the group consisting of phenolic antioxidants and amine antioxidants, and still more preferably phenolic antioxidants.

Among the phenolic antioxidants, tetrakis[methylene-3-(3',5-di-t-butyl-4'-hydroxyphenyl)propionate]methane is preferable. Thus, the antioxidant contained in the lubricating oil composition of the present invention is more preferably tetrakis[methylene-3-(3',5-di-t-butyl-4'-hydroxyphenyl)propionate]methane.

In addition, a plurality of these antioxidants may be combined, and these antioxidants may be combined with an antioxidant having a peroxide decomposition function.

The antioxidant contained in the lubricating oil composition of the present invention preferably has a high boiling point since its volatility affects Noack. Specifically, the boiling point of the antioxidant is preferably 250° C. or higher, more preferably 300° C. or higher.

Further, in this method, an antioxidant is added in an amount of 0.05% by mass or more with respect to the lubricant base oil, which is the poly-α-olefin. "an antioxidant is added in an amount of 0.05% by mass or more with respect to the lubricant base oil, which is the poly-α-olefin" means "an antioxidant is added so that the amount is 0.05 parts by mass when the lubricant base oil which is a poly-α-olefin is 100 parts by mass."

The amount of antioxidant added in the present method is preferably 0.10% by mass or more, more preferably 0.2% by mass or more, still more preferably 0.3% by mass or more, and even still more preferably 0.4% by mass or more, with respect to the poly-α-olefin lubricant base oil.

When the amount of antioxidant added is within the above range, the evaporation loss by the Noack method can be reduced while maintaining the low viscosity.

On the other hand, the amount of antioxidant added in this method is preferably 10% by mass or less with respect to the lubricant base oil, which is the poly-α-olefin. When the amount of the antioxidant to be added is less than the upper limit, the cost of the antioxidant can also be reduced. From the above viewpoint, the amount of antioxidant added in the present method may be 5% by mass or less, or 3% by mass or less, with respect to the lubricant base oil which is the poly-α-olefin.

The present method is a method by adding an antioxidant, so that the evaporation loss by the Noack method is 66% or less of that before adding the antioxidant, however the evaporation loss by the Noack method is preferably 60% or less, more preferably 45% or less, still more preferably 35% or less, even still more preferably 30% or less, of that before adding the antioxidant.

EXAMPLES

The present invention will be described in more detail with reference to examples, however the present invention is not limited by these examples.

The analyzation method and evaluation method of the lubricating oil composition, the poly-α-olefin etc., obtained by Examples and Comparative Examples, and Production Examples, are as follows.

(1) Kinetic Viscosities at 100° C.

The kinetic viscosities at 40° C. and 100° C. were measured according to JIS K 2283.

(2) Evaporation Loss as Determined by the Noack Method

The evaporation loss determined by the Noack method was measured according to the JPI-5S-41 B method.

Production Example 1 (Production of a Dimer of 1-Decene)

4.0 L of 1-decene, 0.9 g (3 mmol) of bis(cyclopentadienyl)zirconium dichloride as a metallocene complex, and methylaluminoxane (manufactured by W. R. Grace & Co., 8 mmol in term of aluminum) were sequentially added into a nitrogen-purged three-necked flask having an interior volume of 5 liters, and the mixture was stirred at room temperature (20° C.). The reaction liquid turned from yellow to red-brown. After 48 hours from the start of the reaction, the reaction was terminated by adding methanol to the reaction liquid, and then an aqueous hydrochloric acid solution was added to the reaction liquid to wash the organic layer. Subsequently, the organic layer was subjected to vacuum distillation to obtain 3100 mL of a fraction (a dimer of 1-decene) with a boiling point of 120 to 125° C./26.6 Pa.

Production Example 2 (Production of Poly-α-Olefin)

Activated alumina (NKHO-24, manufactured by Sumitomo Chemical Co., Ltd.) was added to the dimer of decene obtained in Production Example 1, and nitrogen bubbling treatment was performed to remove oxides and moisture, and the dried dimer of decene was obtained.

A thermometer and a stirrer chip were installed in a glass reaction vessel, and the nitrogen replacement was performed. 1968 mL of the dried dimer of decene was added and heated it while stirring to bring the dried dimer of decene to 30° C. A tert-butyl chloride solution (12 mL, 6.0 mmol) adjusted to a concentration of 0.5 mol/L with the dried dimer of decene was added thereto, and then diethyl aluminum chloride solution (4 mL, 2.0 mmol) adjusted to a concentration of 0.5 mol/L with the dried dimer of decene was added as a catalyst.

The liquid temperature began to rise 10 minutes after adding the catalyst, and 2 minutes later, the liquid temperature began to drop. When the temperature reached 60° C., an aqueous sodium hydroxide solution (1.0 mol/L, 160 mL (NaOH 160 mmol, 6.4 g)) was added to wash the organic layer. Next, it was washed with ion-exchanged water until the pH of the aqueous layer became 9 or less, and magnesium sulfate was added to the organic layer to dry it.

The organic layer was then transferred to an autoclave, 5% by mass of palladium alumina was added and nitrogen replacement was performed, followed by further hydrogen replacement, then the temperature was increased, and the hydrogenation reaction was carried out for 24 hours at a hydrogen pressure of 0.8 MPa at 80° C. to obtain the hydrogenated product.

Next, after distilling off the low-molecular-weight substances from the hydrogenated product under reduced pressure, short-path distillation was performed to obtain the intended poly-α-olefin (a tetramer of decene). The obtained poly-α-olefin (referred to as poly-α-olefin 1) had a kinematic viscosity at 100° C. of 6.07 $mm^2$/sec.

Example 1 (Lubricating Oil Composition)

Tetrakis[methylene-3-(3',5-di-t-butyl-4'-hydroxyphenyl) propionate]methane (Trade name: "Irganox 1010") was added to the poly-α-olefin 1 obtained in Production Example 2 in an amount of 0.5% by mass (with respect to the poly-α-olefin) and dissolved to obtain the lubricating oil composition. The evaporation loss by the Noack method and the kinematic viscosity at 100° C. are shown in Table 1.

Example 2 (Lubricating Oil Composition)

0.5% by mass (with respect to the poly-α-olefin) of zinc dialkyldithiophosphate (ZnDTP) was added to the poly-α-olefin 1 obtained in Production Example 2, and dissolved to obtain the lubricating oil composition. The evaporation loss by the Noack method and the kinematic viscosity at 100° C. are shown in Table 1.

Comparative Example 1 (Poly-α-olefin)

The poly-α-olefin 1 obtained in Production Example 2 was used as a sample in Comparative Example 1. The evaporation loss by the Noack method and the kinematic viscosity at 100° C. are shown in Table 1.

Example 3 (Lubricating Oil Composition)

Tetrakis[methylene-3-(3',5-di-t-butyl-4'-hydroxyphenyl) propionate]methane (Trade name: "Irganox 1010") was added to the poly-α-olefin Durasyn 166 (Trade name: "Durasyn 166", 6cSt product, manufactured by INEOS) in an amount of 0.5% by mass (with respect to the poly-α-olefin) and dissolved to obtain the lubricating oil composition. The evaporation loss by the Noack method and the kinematic viscosity at 100° C. are shown in Table 1.

The poly-α-olefin Durasyn 166 (Trade name: "Durasyn 166", 6cSt product, manufactured by INEOS) contains various hydrocarbon compounds with different molecular structures. The compounds each has a random branched chain. The poly-α-olefin Durasyn 166 is considered to be oligomerized using an acid catalyst or boron trifluoride catalyst.

Comparative Example 2 (Poly-α-olefin)

The poly-α-olefin Durasyn 166 (Trade name: "Durasyn 166", 6cSt product, manufactured by INEOS) was used as a sample for Comparative Example 2. The evaporation loss by the Noack method and the kinematic viscosity at 100° C. are shown in Table 1.

Example 4 (Lubricating Oil Composition)

Tetrakis[methylene-3-(3',5-di-t-butyl-4'-hydroxyphenyl) propionate]methane (Trade name: "Irganox 1010") was added to the poly-α-olefin SpectraSyn6 (Trade name: "SpectraSyn6", 6cSt product, manufactured by ExxonMobil) in an amount of 0.5% by mass (with respect to the poly-α-olefin) and dissolved to obtain the lubricating oil composition. The evaporation loss by the Noack method and the kinematic viscosity at 100° C. are shown in Table 1.

The poly-α-olefin SpectraSyn6 (trade name: "SpectraSyn6", 6cSt product, manufactured by ExxonMobil) contains various hydrocarbon compounds with different molecular structures. The compounds each has a random branched chain. The poly-α-olefin SpectraSyn6 is considered to be oligomerized using an acid catalyst or a boron trifluoride catalyst.

Comparative Example 3 (Poly-α-olefin)

The poly-α-olefin SpectraSyn6 (Trade name: "SpectraSyn6", 6cSt product, manufactured by ExxonMobil) was used as a sample of Comparative Example 3. The evaporation loss by the Noack method and the kinematic viscosity at 100° C. are shown in Table 1.

Comparative Example 4 (Lubricating Oil Composition)

Tetrakis[methylene-3-(3',5-di-t-butyl-4'-hydroxyphenyl) propionate]methane (Trade name: "Irganox 1010") was added to the poly-α-olefin 1 obtained in Production Example 2 in an amount of 0.03% by mass (with respect to the poly-α-olefin) and dissolved to obtain the lubricating oil composition. The evaporation loss by the Noack method and the kinematic viscosity at 100° C. are shown in Table 1.

TABLE 1

| | Lubricating oil composition etc. | | | | | Properties of Lubricating oil composition | |
|---|---|---|---|---|---|---|---|
| | Base oil | | Antioxidant | | | Evaporation | |
| | Type | | Type | | Amount (% by mass with respect to base oil) | loss (Noack method) (%) | Kinematic viscosity at 100° C. ($mm^2$/s) |
| Example 1 | Poly-α-olefin 1 | Poly-α-olefin (tetramer of decene) | Irganox 1010 | Phenolic Antioxidant | 0.5 | 2.1 | 6.07 |

TABLE 1-continued

| | Lubricating oil composition etc. | | | | | Properties of Lubricating oil composition | |
|---|---|---|---|---|---|---|---|
| | Base oil | | Antioxidant | | | Evaporation | |
| | Type | | Type | | Amount (% by mass with respect to base oil) | loss (Noack method) (%) | Kinematic viscosity at 100° C. ($mm^2/s$) |
| Example 2 | Poly-α-olefin 1 | Poly-α-olefin (tetramer of decene) | ZnDTP | Zinc dialkyldithiophosphate | 0.5 | 3.1 | 6.07 |
| Comparative Example 1 | Poly-α-olefin 1 | Poly-α-olefin (tetramer of decene) | Nil | — | — | 7.7 | 6.07 |
| Example 3 | Durasyn 166 | Poly-α-olefin (6 cSt product) | Irganox 1010 | Phenolic Antioxidant | 0.5 | 4.3 | 5.80 |
| Comparative Example 2 | Durasyn 166 | Poly-α-olefin (6 cSt product) | Nil | — | — | 7.0 | 5.80 |
| Example 4 | SpectraSyn 6 | Poly-α-olefin (6 cSt product) | Irganox 1010 | Phenolic Antioxidant | 0.5 | 2.7 | 5.80 |
| Comparative Example 3 | SpectraSyn 6 | Poly-α-olefin (6 cSt product) | Nil | — | — | 5.4 | 5.80 |
| Comparative Example 4 | Poly-α-olefin 1 | Poly-α-olefin (tetramer of decene) | Irganox 1010 | Phenolic Antioxidant | 0.03 | 6.7 | 6.07 |

Since the lubricating oil composition of Examples has the evaporation loss by the Noack method of 4.9% by mass or less, and the kinematic viscosity at 100° C. of 6.5 $mm^2$/sec or less, it can be used as the lubricating oil having low viscosity and small evaporation loss, and suitable for long-term use.

The invention claimed is:

1. A lubricating oil composition, comprising:

a poly-α-olefin having an average carbon number of 36 to 44; and at least one antioxidant selected from the group consisting of tetrakis[methylene-3-(3',5-di-t-butyl-4'-hydroxyphenyl)propionate]methane and a zinc dialkyldithiophosphate, in an amount of 0.1% by mass or more with respect to the poly-α-olefin, wherein an amount of the poly-α-olefin in a base oil of the lubricating oil composition is at least 55% by mass, the lubricating oil composition has an evaporation loss of 4.9% by mass or less by the Noack method and a kinematic viscosity of 6.5 $mm^2$/see or less at 100° C., and the evaporation loss of the lubricating oil composition is 66% or less of an evaporation loss by the Noack method before adding the antioxidant.

2. The lubricating oil composition according to claim 1, wherein the poly-α-olefin is a polymerized product of an α-olefin having 8 to 12 carbon atoms.

3. The lubricating oil composition according to claim 1, wherein the poly-α-olefin is a product obtained by a process comprising dimerizing an α-olefin with a metallocene catalyst, further dimerizing the dimerized product with an acid catalyst, and performing a hydrogenation.

4. The lubricating oil composition according to claim 2, wherein the α-olefin is 1-decene.

5. The lubricating oil composition according to claim 1, wherein a boiling point of the antioxidant is 250° C. or higher.

6. The lubricating oil composition according to claim 1, wherein the antioxidant is tetrakis[methylene-3-(3',5-di-t-butyl-4'-hydroxyphenyl)propionate]methane.

7. An evaporation loss reduction method of a lubricating oil, comprising:

adding 0.05% by mass or more of an antioxidant with respect to a lubricant base oil comprising a poly-α-olefin such that the lubricating oil has an evaporation loss of 66% or less of an evaporation loss by the Noack method before adding the antioxidant.

8. The evaporation loss reduction method according to claim 7, wherein an average carbon number of the poly-α-olefin is in a range of 36 to 44.

9. The lubricating oil composition according to claim 1, wherein the evaporation loss is 4.3% by mass or less by the Noack method.

10. The lubricating oil composition according to claim 2, wherein the poly-α-olefin is a product obtained by a process comprising dimerizing an α-olefin with a metallocene catalyst, further dimerizing the dimerized product with an acid catalyst, and performing a hydrogenation.

11. The lubricating oil composition according to claim 3, wherein the α-olefin is 1-decene.

12. The lubricating oil composition according to claim 2, wherein a boiling point of the antioxidant is 250° C. or higher.

13. The lubricating oil composition according to claim 3, wherein a boiling point of the antioxidant is 250° C. or higher.

14. The lubricating oil composition according to claim 2, wherein the antioxidant is tetrakis[methylene-3-(3',5-di-t-butyl-4'-hydroxyphenyl)propionate]methane.

15. The lubricating oil composition according to claim 1, wherein an amount of the poly-α-olefin in the base oil of the lubricating oil composition is at least 60% by mass.

16. The lubricating oil composition according to claim 1, wherein an amount of the poly-α-olefin in the base oil of the lubricating oil composition is at least 80% by mass.

17. The lubricating oil composition according to claim 1, wherein an amount of the poly-α-olefin in the base oil of the lubricating oil composition is 100% by mass.

18. The lubricating oil composition according to claim 1, wherein the amount of the antioxidant is 0.2% by mass or more with respect to the poly-α-olefin.

19. The lubricating oil composition according to claim 1, wherein the amount of the antioxidant is 0.3% by mass or more with respect to the poly-α-olefin.

20. The lubricating oil composition according to claim 1, wherein the amount of the antioxidant is 0.4% by mass or more with respect to the poly-α-olefin.

* * * * *